United States Patent [19]

Pitcher et al.

[11] Patent Number: 4,567,904

[45] Date of Patent: Feb. 4, 1986

[54] HAIR GRASPING STRUCTURE

[75] Inventors: Gerald K. Pitcher, Stamford, Conn.; Nancy Flinn, New York, N.Y.

[73] Assignee: Clairol Incorporated, New York, N.Y.

[21] Appl. No.: 457,814

[22] Filed: Jan. 13, 1983

[51] Int. Cl.[4] ..... A45D 2/12

[52] U.S. Cl. ..... 132/33 R; 219/225; 132/37 R

[58] Field of Search ..... 132/37 R, 39, 33 R; 219/225

[56] References Cited

U.S. PATENT DOCUMENTS

| | | | |
|---|---|---|---|
| 2,789,075 | 4/1957 | Stahl | 132/39 X |
| 3,888,266 | 6/1975 | Weldon | 132/39 |
| 4,034,201 | 7/1977 | Walter | 132/39 |
| 4,477,716 | 10/1984 | Thaler | 219/225 |

*Primary Examiner*—Gregory E. McNeill

*Attorney, Agent, or Firm*—S. E. Krieger; G. Warzecha

[57] ABSTRACT

A hair grooming device is provided having a biased pivotal clip which is flocked on its underside, upper and peripheral surfaces. The opposing tubular winding portion is also preferably flocked.

6 Claims, 2 Drawing Figures

HAIR GRASPING STRUCTURE

BACKGROUND OF THE INVENTION

1. Field of the Invention

The present invention relates generally to hair grooming devices and more particularly to the hair grasping structure on a curling iron.

2. Description of the Prior Art

Curling irons are well-known in the art of hair grooming. The more current irons include a smooth surface tubular winding portion which is electrically heated internally. The hair is wound around the tubular portion and subjected to the heat transmitted through its surface. Some of these newer irons also include a liquid retaining wick which is brought into contact with the heated internal element so as to vaporize the liquid; the vapor being expelled through perforations in the external surface of the tubular portion into the tress of hair. This type of device is referred to as steam curling iron.

Typically, curling irons have a pivotal clip biased towards the tubular portion for clamping the end of a tress of hair therebetween. The tress is then wound around the tubular portion and over the outer surface of the clip by rotation of the curling iron. In these prior art devices, both the surface of the clip and the tubular portion are conventionally composed of a plastic and/or coated, e.g. with polytetrafluoroethylene, to reduce friction and assist axial removal of the tress from the device, see e.g. U.S. Pat. No. 3,835,292 to Henry Walter et al, commonly assigned herewith, and U.S. Pat. No. 4,151,850 to Nathe et al.

Disadvantages associated with curling irons having a pivotal biased clip are the angulated and overly pronounced ridges impressed into the hair by the underside and edges of the clip, and the persistent slipping of the tress of hair along the length of and off the outer surface of the clip.

It is an object of the present invention to provide a curling iron with a clip which produces a smooth curl having a natural appearance.

It is a further object of the present invention to provide a curling iron having a tubular winding portion with an improved surface which prevents the tress of hair in contact therewith from sliding along and off during grooming and cooperates with the underside surface of the clip for enhanced clamping of a tress of hair therebetween, and reduction in the pronouncement of the ridges in the resultant curl.

SUMMARY OF THE INVENTION

These and other objectives are accomplished by the present invention which is a hair grooming device comprising the following: a housing having a tubular winding portion for winding a tress of hair therearound; and a clip pivotably secured to the housing and biased towards the tubular portion, the clip having a flocked underside surface for clamping the tress of hair wound around said tubular portion and a flocked upper surface for grasping the tress of hair wound around said surface, wherein said flocking retards the sliding of the tress of hair along said surfaces and prevents the formation of ridge impressions in the hair during clamping. Preferably, the surface of the tubular portion is also flocked.

BRIEF DESCRIPTION OF THE DRAWINGS

The foregoing and other objects, characteristics and advantages of the present invention will be more clearly understood from the following description when read in conjunction with the accompanying drawings in which.

DESCRIPTION OF THE PREFERRED EMBODIMENT

Figure 1:
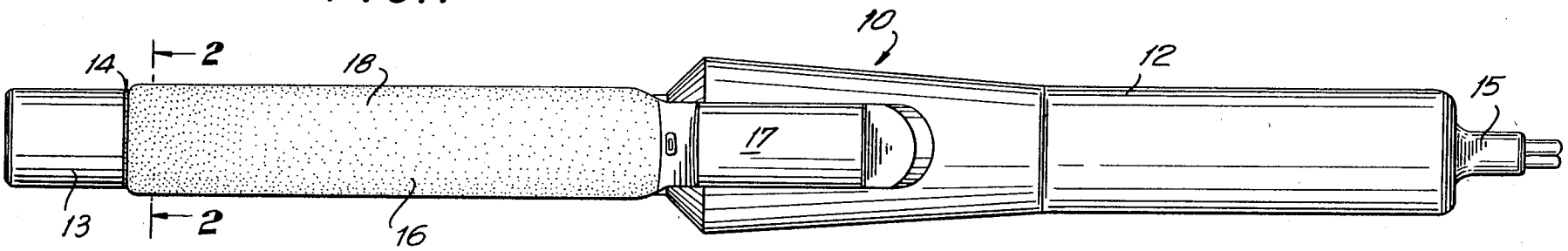
FIG. 1 is a top plan view of a curling iron in accordance with the present invention.
Figure 2:
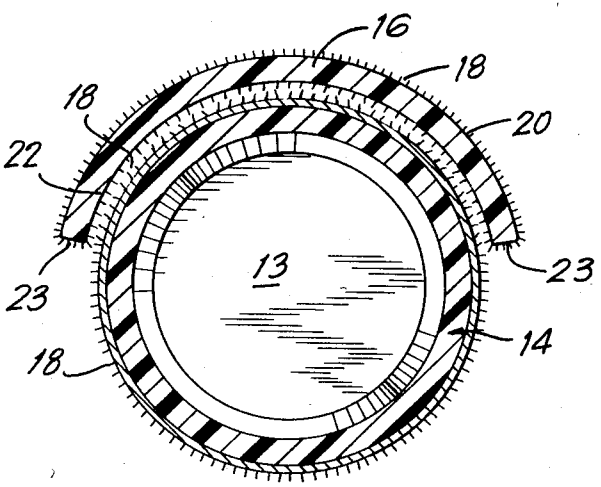
FIG. 2 is a cross-sectional view taken along line 2—2 of FIG. 1.

Referring now to the FIGS. wherein a curling iron in accordance with the present invention, generally indicated by the numeral 10, has a handle portion 12 and a tubular portion 14. A clip 16, mounted on the handle portion 12, is pivotably biased towards the tubular portion in a manner well-known in the art, e.g. U.S. Pat. Nos. 4,365,140 to Kunz et al. and 3,835,292 to Henry Walter, et al. The clip 16 is operable by a button 17 which functions upon depression to swing or pivot the clip 16 away from the tubular portion 14. After pivoting the clip 16, the end of the tress of hair sought to be curled is placed on the tubular portion 14 so that upon release of the button 17 the tress end is clamped between the clip 16 and tubular portion 14. At the end of the tubular winding portion 14 is a cool tip 13 which permits the user to hold the curling iron in both hands, one hand on the handling portion 12 and the other on the cool tip 13, thereby facilitating the winding of the clamped tress about the tubular portion 14 by rotation of the curling iron 10.

The tubular portion 14 is hollow and contains an inner mechanism such as a heat generator, in accordance with devices well-known in the art. Alternatively, the inner mechanism is a vapor generator capable of producing steam, which is expelled through apertures in through the surface in the tubular portion, also in accordance with devices well known in the art. An electric cord 15 is connected to an outside power source to energize the inner mechanism.

The clip has flocking 18 on its top or upper surface 20 and its underside surface 22, with thousands of filaments applied per square inch of flocked surface. The multitude of flocking filaments 18 on the clip underside 22 grasps the tress end so as to reduce sliding along the tubular portion 14. The flocked underside 22 also helps to prevent the formation of angulated or overly pronounced ridges in the clamped tress end.

It is preferable, as shown, to also flock the peripheral surface 23 of the clip 16, and the entire surface of the tubular portion 14. The hair tress, consequently, upon clamping, has its end sandwiched between two flocked surfaces, the underside of the clip 22 and the opposed tubular portion 14. This arrangement further enhances the grasping of the hair tress. The flocked peripheral surface 23 further softens the clamping surfaces and substantially reduces or eliminates the formation of pronounced ridges. Partial flocking of the clip underside 22, top surface 20 and surface of the tubular portion 14 is also contemplated.

When the hair tress is clamped between the two opposing flocked surfaces 22 and 14, and is wound about the outer surface of the flocked tubular portion 14 and over the flocked upper surface 20 of the hair clip 16, and subjected to heat or steam, a smooth natural-looking curl results.

The tress end may be lubricated with hair treatment liquids prior to clamping between the opposed flocking surfaces 22 and 14. The non-hygroscopic nature of the flocking 18 on opposite sides of the hair tress during clamping severly retards evaporation of the treatment liquid from the hair, while permitting exposure to the heat or steam transmitted by the internal mechanism through the surface of the tubular winding portion to achieve more effective curling.

While the flocking, as shown, is applied directly to the tubular portion 14, other forms of attachment are also appropriate. For example, the flocking may be mounted on a strip (not shown) which is secured to the clip underside surface 22, upper surface 20 or tubular portion 14 by mechanical means, such as physical interlocking between the strip and surface, or by adhesion to the surface, as described in co-pending application to Paul Bertelsen, et al., commonly assigned herewith.

Flocking may be applied according to methods well-known in the art, e.g. U.S. Pat. No. 3,888,266 to Weldon, et al. For example, the clip 16 may be coated with an adhesive and the short filaments of synthetic materials, referred to as flocking, are electrostatically applied to the glue. The filaments are positioned with one end in the glue, the length of the filaments extended normally from the top surface 20 and underside 22 of the clip, and the other end free. The filaments are preferably composed of nylon having a length of 0.03–0.05 inches, a diameter of 0.001–0.002 inches and a concentration of 4,000–6,000 filaments/square inch. Clearly other flocking dimensions, material and concentrations are suitable.

What is claimed is:

1. A hair grooming device comprising:

a housing having a tubular winding portion for winding a tress of hair therearound;

and a clip pivotably secured to the housing and biased towards the tubular portion, the clip having a flocked underside surface for clamping the tress of hair wound around said tubular portion and a flocked upper surface for grasping the tress of hair wound around said surface, wherein said flocking retards the sliding of the tress of hair along said surfaces and prevents the formation of ridge impressions in the hair during clamping.

2. The device of claim 1 wherein said tubular winding portion is flocked.

3. The device of claim 1 wherein said clip has a flocked peripheral surface, said peripheral surface being disposed between said underside surface and upper surface.

4. The device of claim 3 wherein said underside surface, upper surface, peripheral and tubular portion are fully flocked.

5. The device of claim 1 wherein said tubular portion has a heat generator therewithin.

6. The device of claim 4 wherein said tubular portion has a vapor generator therewithin and said flocked tubular portion has perforations for expelling said vapor into the hair tress wound therearound.

* * * * *